US011920370B2

(12) United States Patent
Liu et al.

(10) Patent No.: US 11,920,370 B2
(45) Date of Patent: Mar. 5, 2024

(54) UNDERGROUND TEMPORARY DANGER AVOIDING SYSTEM FOR DEFENDING AGAINST SHORT-DURATION AND STRONG IMPACT OF GROUND FLUID

(71) Applicant: China Institute of water Resources and Hydropower Research, Beijing (CN)

(72) Inventors: Jiahong Liu, Beijing (CN); Tianxu Song, Beijing (CN); Chao Mei, Beijing (CN); Jia Wang, Beijing (CN); Hao Wang, Beijing (CN)

(73) Assignee: China Institute of water Resources and Hydropower Research, Beijing (CN)

( * ) Notice: Subject to any disclaimer, the term of this patent is extended or adjusted under 35 U.S.C. 154(b) by 0 days.

(21) Appl. No.: 18/126,488

(22) Filed: Mar. 27, 2023

(65) Prior Publication Data

US 2024/0011314 A1 Jan. 11, 2024

(30) Foreign Application Priority Data

Jul. 7, 2022 (CN) ..... 202210794115.7

(51) Int. Cl.
*E04H 9/14* (2006.01)
*E04H 9/16* (2006.01)

(52) U.S. Cl.
CPC ..... *E04H 9/145* (2013.01); *E04H 9/16* (2013.01)

(58) Field of Classification Search
CPC ..... E04H 9/14; E04H 9/16; E04H 9/145
See application file for complete search history.

(56) References Cited

U.S. PATENT DOCUMENTS 4,872,470 A * 10/1989 Hayashida ..... E04H 9/16 135/153
2002/0046515 A1* 4/2002 Mccarthy ..... E04H 9/12 52/169.6

(Continued)

FOREIGN PATENT DOCUMENTS

CN 108022053 A 5/2018
CN 111652777 A 9/2020

(Continued)

*Primary Examiner* — Christine T Cajilig
(74) *Attorney, Agent, or Firm* — Georgi Korobanov

(57) ABSTRACT

The invention relates to a perforating device for thermoplastic plates, which relates to the technical field of a plate processing device. The device comprises an electromagnetic chuck, one side of the electromagnetic chuck is connected with the motion part, the other side of the electromagnetic chuck is connected with a mounting plate and a spike. When the electromagnetic chuck is powered on, the spike is attracted below the mounting plate by the electromagnetic force. A clamping part is arranged below the mounting plate, the thermoplastic plate is fixed by the clamping part, and a heating system is also provided to heat the thermoplastic plate. As the electromagnetic chuck is powered on or off, the spike can be attracted in or separated from the mounting plate, respectively. Therefore, the perforating device can make a new plate be pierced during the cooling and curing process of the perforated plate.

3 Claims, 5 Drawing Sheets

(56) References Cited

U.S. PATENT DOCUMENTS

| | | | | |
|---|---|---|---|---|
| 2013/0205691 | A1* | 8/2013 | Shalev | F28F 1/00 52/741.12 |
| 2015/0019262 | A1* | 1/2015 | Du | G06Q 40/08 705/4 |
| 2022/0349201 | A1* | 11/2022 | Barber | E04H 9/145 |

FOREIGN PATENT DOCUMENTS

| | | | | |
|---|---|---|---|---|
| CN | 214996505 | U | 12/2021 | |
| WO | WO-2007110489 | A1 * | 10/2007 | E04H 9/02 |

* cited by examiner

UNDERGROUND TEMPORARY DANGER AVOIDING SYSTEM FOR DEFENDING AGAINST SHORT-DURATION AND STRONG IMPACT OF GROUND FLUID

FIELD OF THE INVENTION

The present invention belongs to the technical field of emergency danger avoiding devices, and in particular relates to an underground temporary danger avoiding system for defending against a short-duration and strong impact of a ground fluid.

BACKGROUND OF THE INVENTION

In China, a large number of cascade reservoir groups have been built in a plurality of drainage basins, the reservoirs are at risk of dangerous situations under extreme environments such as earthquakes and heavy rainfall, and the cascade reservoirs will cause the dangerous situations to spread in a chain until the last reservoir forms a huge flood disaster. The flood has a short duration and a strong impact, which will cause destructive damage to densely populated areas such as villages, towns, markets and cities along the way, and threatens the lives of people along the way. When a chain disaster occurs, an early warning can be timely notified to the people living downstream, however, the flood has a high propagation speed, there will still be people who are too late to transfer, and their lives are greatly threatened. Under the flood with high water heads and a strong impact, the traditional flood control and lifesaving high platform cannot solve the danger caused by flood climbing due to the extremely short danger avoiding time and the limited height of the lifesaving high platform, which is difficult to ensure the life safety of danger avoiders. In the face of the danger avoiding requirements under extreme disaster conditions such as the burst of cascade reservoir groups, it is urgently needed to invent a novel underground temporary danger avoiding system, and to provide a corresponding scientific design method and parameters.

SUMMARY OF THE INVENTION

In view of the above defects in the prior art, the present invention is intended to provide an underground temporary danger avoiding system for defending against a short-duration and strong impact of a ground fluid, so as to solve the problem that the traditional flood control and lifesaving high platform cannot solve the danger caused by the flood climbing due to the extremely short danger avoiding time and the limited height of the lifesaving high platform under the flood with high water heads and a strong impact, which is difficult to ensure the life safety of danger avoiders.

For the above objective, the present invention adopts technical schemes as follows.

An underground temporary danger avoiding system for defending against a short-duration and strong impact of a ground fluid comprises a danger avoiding chamber having a danger avoiding service radius of r; a danger avoiding entrance arranged at a position in the danger avoiding chamber that is close to danger avoiders, and a rescue exit arranged at a position of the highest point of the danger avoiding chamber; waterproof doors resisting to high water heads and unidirectionally opened outwards that are arranged at both the danger avoiding entrance and the rescue exit; an alarm apparatus arranged at the danger avoiding entrance; and a rotary stair leading to the rescue exit that is arranged in the danger avoiding chamber, and a life support system and a rescue device configured in the danger avoiding chamber.

Further, the life support system comprises a harmful gas removal device, an oxygen supply device, a lighting device, and a device for storing food, clothing and drinking water.

Further, the rescue device includes a satellite communication device, an emergency power supply, a lifebuoy, a life jacket, and a lifeboat.

Further, determining the danger avoiding service radius r comprises:

$$v = C\sqrt{RJ}$$

$$C = \frac{1}{n}R^{\frac{1}{6}}$$

$$r = \frac{S}{v} - t_{notice}$$

wherein v is a flood propagation speed, C is Chezy coefficient, R is a hydraulic radius, J is a hydraulic gradient, n is watercourse roughness coefficient, $t_{notice}$ is notification time, and S is a river length.

Further, the high water head, i.e., a land surface water depth h g, which the waterproof doors resist is calculated as:

$$Q_{down} = Q_{up} * (1-\alpha)^{\frac{S}{1000}}$$

$$Q_{down} = AC\sqrt{RJ}$$

$$R = \frac{(x_2 - x_1) * h_r - \int_{x_1}^{x_2} f(x)dx}{\int_{x_1}^{x_2} \sqrt{1 + (f'(x))^2}\, dx}$$

$$A = (x_2 - x_1) * h_r - \int_{x_1}^{x_2} f(x)dx$$

$$h_g = \frac{h_r}{2} * (1-\beta)^{\frac{r}{1000}}$$

wherein $Q_{up}$ is a flow rate of an upstream section, $Q_{down}$ is a flow rate of a downstream section, S is a river length, $\alpha$ is flood peak attenuation coefficient, A is a section area, C is Chezy coefficient, R is a hydraulic radius, J is a hydraulic gradient, n is watercourse roughness coefficient, $h_r$ is a river water depth, $h_g$ is a land surface water depth, $\beta$ is land surface flood water depth attenuation coefficient, $x_1$ and $x_2$ are starting point distances corresponding to two banks when the water depth is $h_r$, f (x) is a polynomial function fitted by an irregular section, and the section f (x) is the derivative of the fitting equation f (x).

Further, $h_g$ is solved as:

$$\left[\frac{(x_2 - x_1) * 2 * h_g}{(1-\beta)^{\frac{r}{1000}}} - \int_{x_1}^{x_2} f(x)dx\right] * C\sqrt{\frac{\frac{(x_2 - x_1) * 2 * h_g}{(1-\beta)^{\frac{r}{1000}}} \int_{x_1}^{x_2} f(x)dx}{\int_{x_1}^{x_2} \sqrt{1 + (f'(x))^2}\, dx} J} = Q_{up} * (1-\alpha)^{\frac{S}{1000}}$$

which is simplified into:

$$c_1^2 c_3 h_g^3 - (c_1^2 c_4 + 2c_1 c_2 c_3) h_g^2 + (2c_1 c_2 c_4 + c_2^2 c_3) h_g - (c_2^2 c_4 + c_5) = 0$$

wherein $c_1$, $c_2$, $c_3$, $c_4$, $c_5$ are constants:

$$\begin{cases} c_1 = \dfrac{(x_2 - x_1) * 2}{(1-\beta)^{\frac{r}{1000}}} C \\ c_2 = \displaystyle\int_{x_1}^{x_2} f(x)dx * C \\ c_3 = \dfrac{(x_2 - x_1) * 2 * J}{\displaystyle\int_{x_1}^{x_2} \sqrt{1 + (f'(x))^2}\, dx * (1-\beta)^{\frac{r}{1000}}} \\ c_4 = \dfrac{\displaystyle\int_{x_1}^{x_2} f(x)dx * J}{\displaystyle\int_{x_1}^{x_2} \sqrt{1 + (f'(x))^2}\, dx} \\ c_5 = Q_{up} * (1-\alpha)^{\frac{S}{1000}} \end{cases}.$$

The underground temporary danger avoiding system for defending against a short-duration and strong impact of a ground fluid provided by the present invention has the following beneficial effects.

The underground temporary danger avoiding system according to the present invention can protect danger avoiders under a short-duration and strong-impact flood, solve the problem of flood climbing when the traditional flood control and lifesaving high platform is in the face of flood with high water heads and a strong impact, and have the advantages of high safety and strong practicability.

Figure 1:
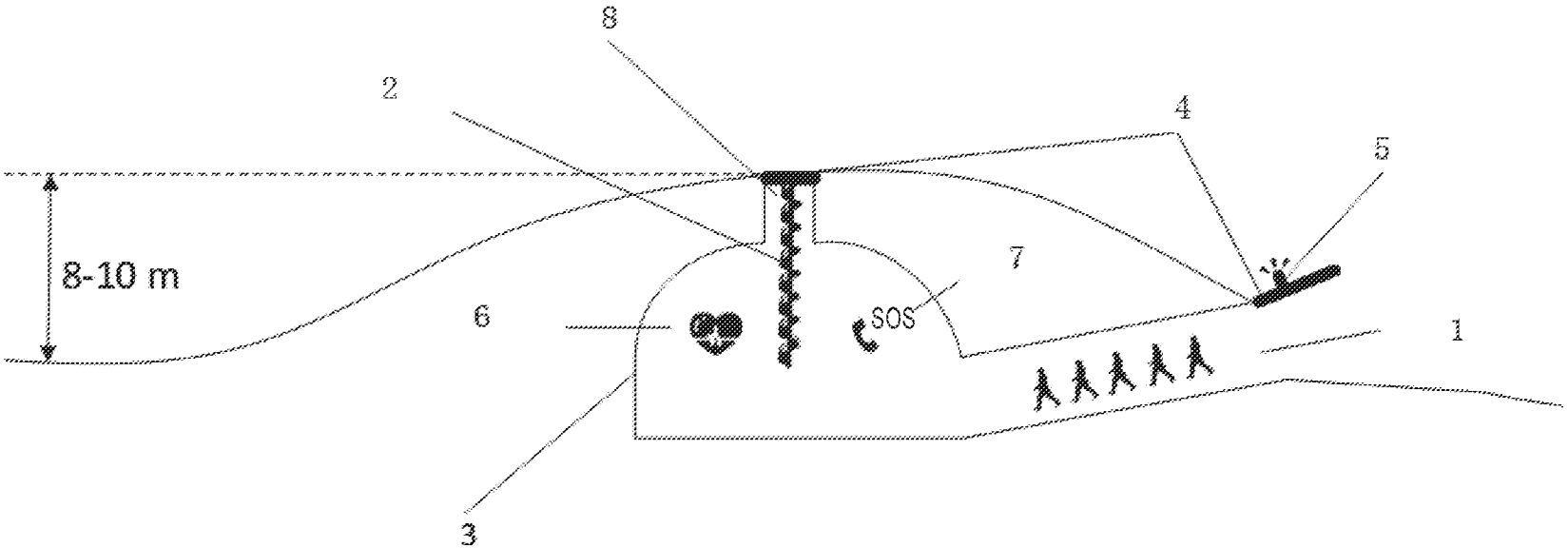
FIG. 1 is a diagram of danger avoidance and transfer according to the present invention.

Numerals in the drawings: 1. danger avoiding entrance; 2. rescue exit; 3. danger avoiding chamber; 4. waterproof door; 5. alarm apparatus; 6. life support system; 7. rescue device; 8. rotary stair; and 9. silt deposits.

DETAILED DESCRIPTION OF THE EMBODIMENTS

The following description of the specific embodiments of the present invention is provided to facilitate the understanding of the present invention by those skilled in the art, however, it should be understood that the present invention is not limited to the scope of the specific embodiments, and for those of ordinary skill in the art, various changes that are made without departing from the spirit and scope of the present invention as defined and determined by the appended claims are apparent, and all inventions and creations that are made by using the concept of the present invention are within the protective scope.

Example 1: referring to FIG. 1, which shows an underground temporary danger avoiding system for defending against a short-duration and strong impact of a ground fluid of this scheme, this example can provide a shelter for danger avoiders under a short-duration and strong impact of a fluid, and specifically comprises: a danger avoiding chamber 3 having a danger avoiding service radius of r, wherein the danger avoiding chamber 3 is configured to resist the impact of the flood and still has a waterproof effect under the hydrostatic pressure of 8-10 meters;

a danger avoiding entrance 1 arranged at a position in the danger avoiding chamber 3 that is close to danger avoiders, and a rescue exit 2 arranged at a position of the highest point of the danger avoiding chamber 3, wherein the danger avoiding entrance 1 is configured for danger avoiders to enter the danger avoiding chamber 3, and the rescue exit 2 is configured for danger avoiders to exit the danger avoiding chamber 3;

waterproof doors 4 resisting high water heads and unidirectionally opened outwards that are arranged at both the danger avoiding entrance 1 and the rescue exit 2, wherein the waterproof doors 4 have a capability of resisting a short-duration and strong impact of a ground fluid to defend against the impact of the flood, the waterproof doors 4 have a capability of resisting high water heads, which can ensure that water flow is prevented from entering under the water head of 8-10 meters, and the waterproof doors 4 are unidirectionally opened outwards, which can be safer when bearing water pressure;

an alarm apparatus 5 arranged at the danger avoiding entrance 1, so that danger avoiders quickly find a position at which the entrance is located;

a rotary stair 8 leading to the rescue exit 2 that is arranged in the danger avoiding chamber 3, wherein the rotary stair 8 is configured for danger avoiders to transfer after disasters; and a life support system 6 and a rescue device 7 configured in the danger avoiding chamber 3.

The life support system 6 comprises a harmful gas removal device, an oxygen supply device, a lighting device, and a device for storing food, clothing and drinking water, and provides a living environment while protecting danger avoiders from the flood; and the devices in the lift support system all are devices in the prior art, so that the structures thereof are not described in detail.

This example provides an oxygen supply principle of the oxygen supply device:

The oxygen supply device mainly comprises sodium peroxide ($Na_2O_2$), which reacts with carbon dioxide ($CO_2$) in the air to generate sodium carbonate ($Na_2CO_3$) and oxygen gas ($O_2$), and may further react with water ($H_2O$) to generate sodium hydroxide (NaOH) and oxygen gas ($O_2$), wherein the reaction equations are as follows:

$$2Na_2O_2+2CO_2=2Na_2CO_3+O_2$$

$$2Na_2O_2+2H_2O=4NaOH+O_2\uparrow$$

The carbon dioxide in the air may be reduced while the oxygen gas is provided to maintain the air pressure balance in the closed danger avoiding facility.

The rescue device 7 includes a satellite communication device, an emergency power supply, a lifebuoy, a life jacket, and a lifeboat, which are convenient for rescue communication and follow-up rescue work.

The rescue exit 2 of this example should be built h g meters higher than the local height, which reduces the pressure head of flood to the waterproof doors 4 and may prevent the silt deposits 9 from depositing and blocking the exit; the rescue exit 2 is built at a position that is convenient to rescue, so that the rescue may be conveniently and quickly performed after the flood peak; and the danger avoiding chamber 3 is configured to accommodate danger avoiders and protect danger avoiders from the flood discharging process.

The danger avoiding system of this example has a certain service range, and when a short-duration and strong-impact ground flood occurs, in order to ensure that danger avoiders in the service radius can transfer into the danger avoiding facility, in this example, a position of the danger avoiding system with the optimal distance from the danger avoiders may be selected according to the determination of the service radius, and the determination of the danger avoiding service radius r comprises:

$$v = C\sqrt{RJ}$$

$$C = \frac{1}{n}R^{\frac{1}{6}}$$

$$r = \frac{S}{v} - t_{notice}$$

wherein v is a flood propagation speed, C is Chezy coefficient, R is a hydraulic radius, J is a hydraulic gradient, n is watercourse roughness coefficient, $t_{notice}$ is notification time, and S is a river length.

The danger avoiding entrance 1 of this example is built at a position close to the danger avoiders, and the height is close to the residence of the danger avoiders, so that the danger avoiders conveniently enter the danger avoiding entrance; the danger avoiding entrance 1 is provided with waterproof doors 4 with corresponding specification, the waterproof doors 4 have a capability of resisting an impact to defend against the impact of the flood, and the waterproof doors 4 have a capability of resisting high water heads, which can ensure that water flow is prevented from entering under high water head; and the waterproof doors 4 can resist a size $h_g$ of the water head:

The high water head, i.e., a land surface water depth $h_g$, which the waterproof doors 4 resist is calculated as:

$$Q_{down} = Q_{up} * (1-\alpha)^{\frac{S}{1000}}$$

$$Q_{down} = AC\sqrt{RJ}$$

$$R = \frac{(x_2 - x_1) * h_r - \int_{x_1}^{x_2} f(x)dx}{\int_{x_1}^{x_2} \sqrt{1 + (f'(x))^2}\, dx}$$

$$A = (x_2 - x_1) * h_r - \int_{x_1}^{x_2} f(x)dx$$

$$h_g = \frac{h_r}{2} * (1-\beta)^{\frac{r}{1000}}$$

wherein $Q_{up}$ is a flow rate of an upstream section, $Q_{down}$ is a flow rate of a downstream section, S is a river length, α is flood peak attenuation coefficient, A is a section area, C is Chezy coefficient, R is a hydraulic radius, J is a hydraulic gradient, n is watercourse roughness coefficient, $h_r$ is a river water depth, $h_g$ is a land surface water depth, β is land surface flood water depth attenuation coefficient, $x_1$ and $x_2$ are starting point distances corresponding to two banks when the water depth is $h_r$, f (x) is a polynomial function fitted by an irregular section, and the section f'(x) is the derivative of the fitting equation f (x).

$h_g$ is solved as:

$$\left[\frac{(x_2 - x_1) * 2 * h_g}{(1-\beta)^{\frac{r}{1000}}} - \int_{x_1}^{x_2} f(x)dx\right] * C\sqrt{\frac{\frac{(x_2 - x_1) * 2 * h_g}{(1-\beta)^{\frac{r}{1000}}}\int_{x_1}^{x_2} f(x)dx}{\int_{x_1}^{x_2} \sqrt{1 + (f'(x))^2}\, dx}J} = Q_{up} * (1-\alpha)^{\frac{S}{1000}}$$

which is simplified into:

$$c_1^2 c_3 h_g^3 - (c_1^2 c_4 + 2c_1 c_2 c_3) h_g^2 + (2c_1 c_2 c_4 + c_2^2 c_3) h_g - (c_2^2 c_4 + c_5) = 0$$

wherein $c_1$, $c_2$, $c_3$, $c_4$, $c_5$ are constants, which may be determined according to the hydrogeological conditions of the specific position;

$$\begin{cases} c_1 = \dfrac{(x_2 - x_1) * 2}{(1-\beta)^{\frac{r}{1000}}} C \\ c_2 = \displaystyle\int_{x_1}^{x_2} f(x)dx * C \\ c_3 = \dfrac{(x_2 - x_1) * 2 * J}{\displaystyle\int_{x_1}^{x_2} \sqrt{1 + (f'(x))^2}\, dx * (1-\beta)^{\frac{r}{1000}}} \\ c_4 = \dfrac{\displaystyle\int_{x_1}^{x_2} f(x)dx * J}{\displaystyle\int_{x_1}^{x_2} \sqrt{1 + (f'(x))^2}\, dx} \\ c_5 = Q_{up} * (1-\alpha)^{\frac{S}{1000}} \end{cases}.$$

According to the local hydrogeological conditions, a proper flood peak attenuation coefficient and a proper land surface flood attenuation coefficient are selected, the water depth $h_g$ when the flood reaches the danger avoiding facility is calculated, and the waterproof doors 4 are built according to $h_g$ to resist the flood attack.

The final solution of the above equation to the water depth $h_g$ is a unitary cubic equation, and the solution process is a conventional means and is not described in detail herein.

The present invention has the creativity that a principle scheme of a novel underground temporary danger avoiding system for defending against a short-duration and strong impact of a ground fluid is provided, and an original and scientific calculation method is provided for the design of the structural parameters of the underground temporary danger avoiding system. By combining the scheme and the calculation method, the target of the present invention can be achieved, and the target of scientific and effective disaster avoidance is achieved, which has remarkable substantial innovation and technological progress.

The danger avoiding working principle of this example is as follows.

Timely danger avoidance and transfer before flood occurrence:

referring to FIG. 1, when a dangerous situation occurs upstream and endangers the life safety of danger avoiders living downstream, rescue entrance waterproof doors 4 are opened immediately, a life support system 6 is started, a harmful gas removal device is started, an oxygen supply device is started to provide oxygen gas necessary for lives of danger avoiders, a lighting device is started to guide the danger avoiders to gradually transfer to the safe position in the danger avoiding chamber 3, an alarm is sounded at a rescue entrance, the surrounding danger avoiders rapidly transfer to the danger avoiding chamber 3, and when the danger avoiders are completely transferred to the danger avoiding chamber 3, the rescue entrance waterproof doors 4 are closed to prepare to defend against the impact of the flood.

Figure 2:
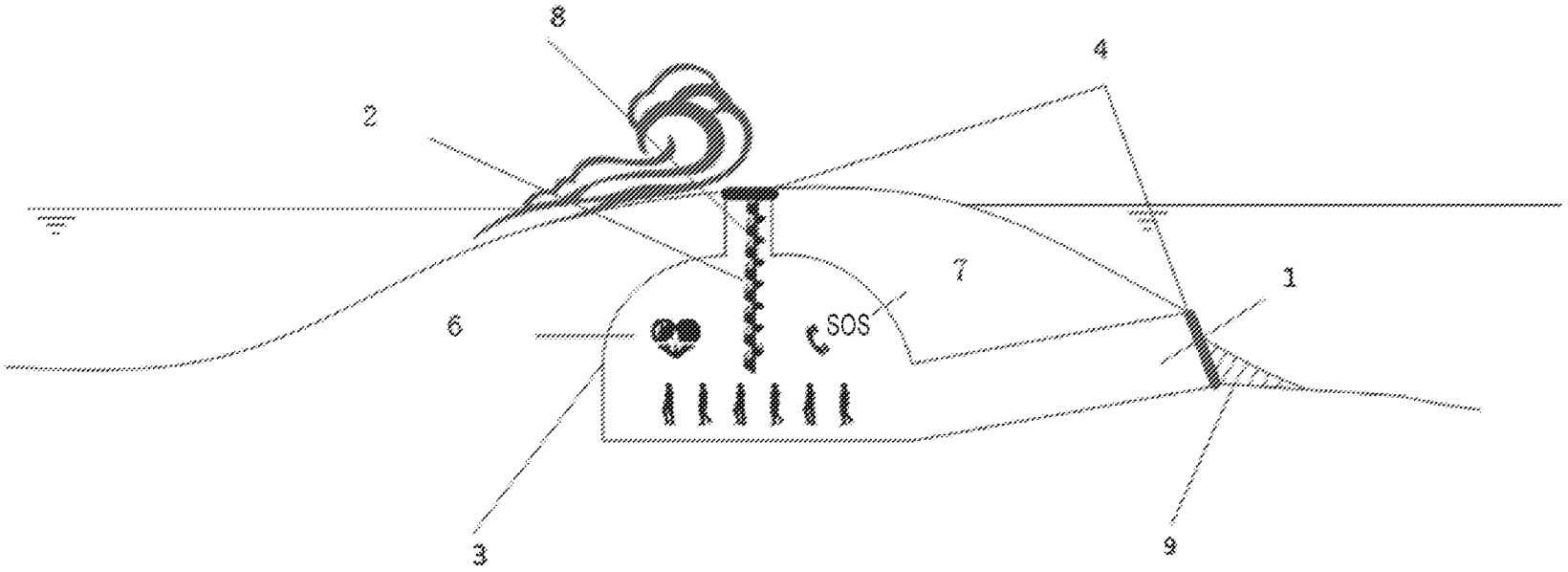
FIG. 2 is a diagram of a flood attack according to the present invention.

Flood Impact Avoidance:

referring to FIG. 2, the waterproof doors 4 at the danger avoiding entrance 1 and the rescue exit 2 are all closed, the life support system 6 in the danger avoiding chamber 3 is started to distribute heat preservation clothing for the danger avoiders, which prevents the danger avoiders from being injured due to the closed low-temperature environment, and food and drinking water are distributed when flood attacks for a long time to meet normal living requirements of the danger avoiders; at the moment, the rescue entrance is submerged by water, and the flood climbing impacts the rescue exit 2, however, the interior of the danger avoiding chamber 3 is relatively stable. The danger avoiders in the danger avoiding chamber 3 can communicate with the outside through the satellite communication device, and a rescue team may conduct psychological guidance and technical rescue on the danger avoiders, know the internal situation and facilitate follow-up rescue.

Figure 3:
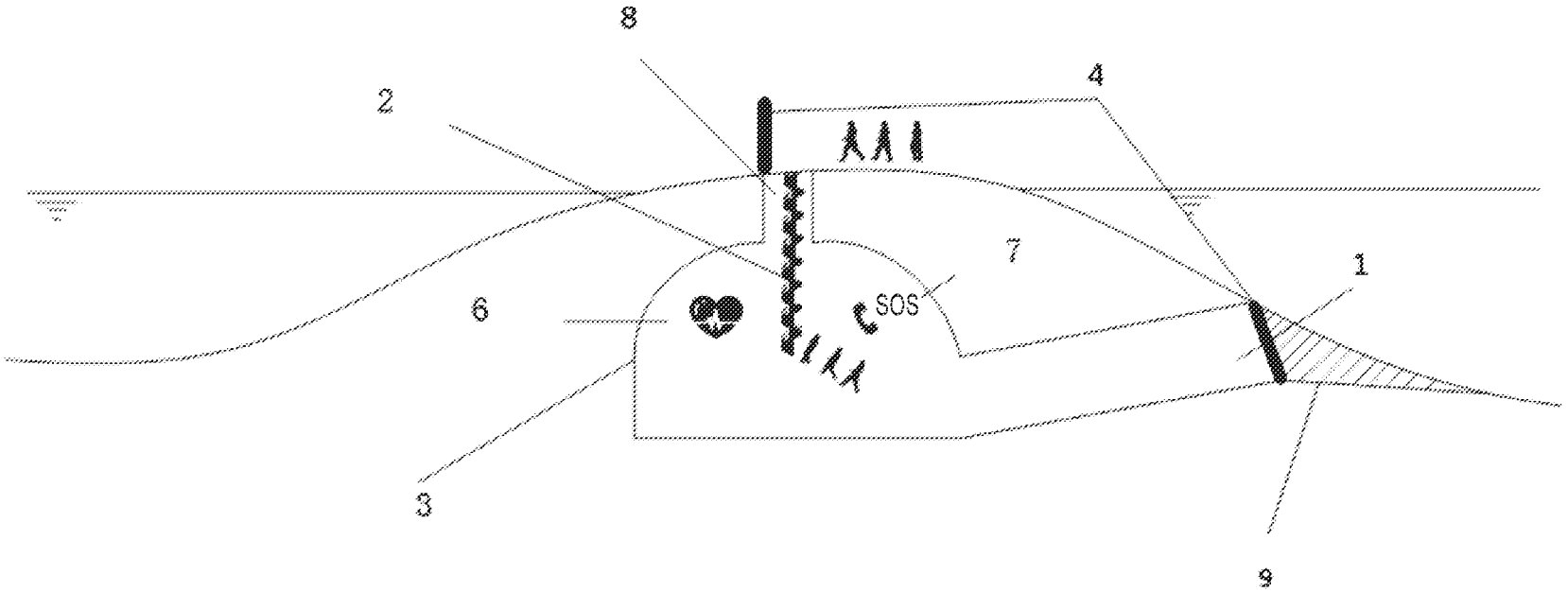
FIG. 3 is a diagram of the rescue after a flood peak.

Timely Rescue after Flood Peak:

referring to FIG. 3, after the flood peak, the flood water level is lowered, however, the danger avoiding entrance 1 is still submerged by water and blocked by the silt deposits, and the waterproof door 4 cannot be opened; the rescue exit 2 is exposed out of the water and is not submerged by flood, and no excessive deposit is generated, so that the waterproof door 4 can be opened from the outside to start to the rescue, the stair leading from the danger avoiding chamber 3 to the rescue exit 2 may provide convenience for rescue, and the lifebuoy, the life jacket and the lifeboat in the danger avoiding chamber 3 also provide support for rescue.

Figure 4:
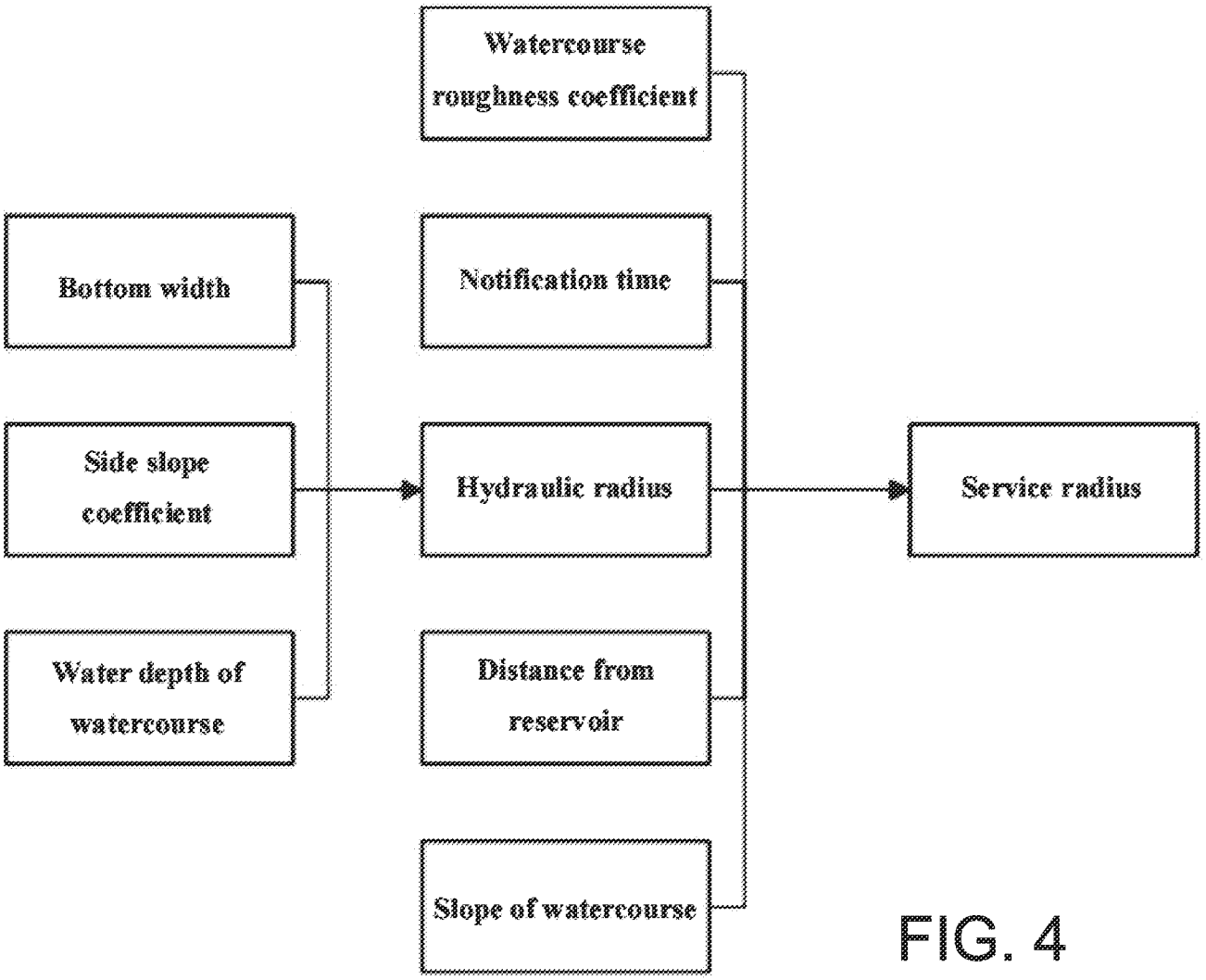
FIG. 4 is a flowchart of calculating a service radius.
Figure 5:
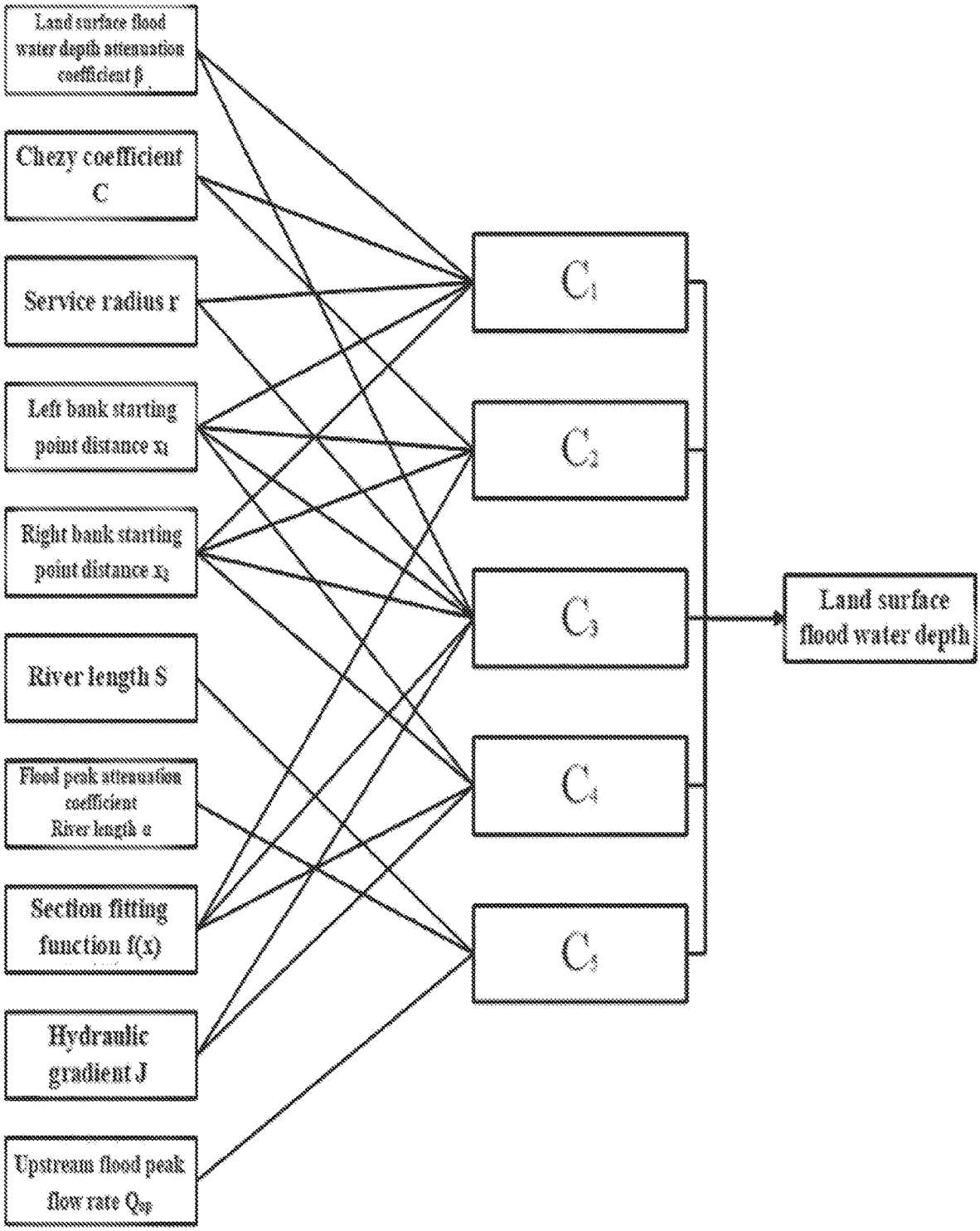
FIG. 5 is a flowchart of calculating a flood water depth, i.e., a land surface water depth.

Example 2: referring to FIG. 4 and FIG. 5, this example is a further technical scheme based on Example 1, and is specifically as follows.

A certain city is located downstream of the cascade reservoir, and its distance from the last reservoir is 14888.8 m, the slope of the watercourse is 0.0019, the watercourse is a trapezoid section, the bottom width of the trapezoid is 98.62 m, the side slope coefficient is 1.528, the maximum water depth of the watercourse is 23 m, and the watercourse roughness coefficient is 0.1.

The above data are substituted into the calculation formula in Example 1, and it can be calculated that when the water depth is maximum, the hydraulic radius R=16.85 m. The notification time is set to 30 min, and the service radius is calculated as r=2300 m. That is, residents within the range of 2300 m around the danger avoiding facility can be safely transferred into the danger avoiding facility after receiving a notification half an hour after the reservoir dam bursts; and after upstream cascade reservoirs continuously burst, the flood peak flow rate generated at the last reservoir is 1.2 million $m^3/s$, and according to the local hydrogeological conditions, the flood peak reduction amount is selected to be 14.23% per kilometer. In the worst case, the dam bursts after the flood peak reaches the vicinity of the urban area, and at this time, the dam flood flows to the urban area and quickly flattens. The land surface flood water depth attenuation coefficient is set to 50% per kilometer, then $c_1$, $c_2$, $c_3$, $c_4$, $c_5$ is solved and obtained, which is substituted for further calculation, and a flood water depth, i.e., a land surface water depth $h_g$=8.15 m, when the flood reaches the danger avoiding facility is solved. Therefore, the height of the danger avoiding facility built in this city is 8.15 m, and the waterproof doors 4 can defend against at least the water pressure of a water head of 8.15 m.

The specific embodiments of the present invention have been described in detail in conjunction with the drawings, however, it should not be construed as limiting the scope of protection of the present invention. Various modifications and variations that can be made within the scope described in the claims by those skilled in the art without creative efforts still belong to the protection scope of the present invention.

What is claimed is:

1. An underground temporary danger avoiding system for defending against a short-duration and strong impact of a ground fluid, comprising: a danger avoiding chamber having a danger avoiding service radius of r; a danger avoiding entrance arranged at one side of the danger avoiding chamber and a rescue exit arranged at a position of the highest point of the danger avoiding chamber; waterproof doors resisting high water heads and unidirectionally opened outwards that are arranged at both the danger avoiding entrance and the rescue exit; an alarm apparatus arranged at the danger avoiding entrance; and a rotary stair leading to the rescue exit that is arranged in the danger avoiding chamber, and a life support system and a rescue device configured in the danger avoiding chamber;

wherein the danger avoiding service radius r is determined by an equation, comprising:

$$v = C\sqrt{RJ}$$

$$C = \frac{1}{n}R^{\frac{1}{6}}$$

$$r = \frac{S}{v} - t_{notice}$$

wherein v is a flood propagation speed, C is Chezy coefficient, R is a hydraulic radius, J is a hydraulic gradient, n is watercourse roughness coefficient, is notification time, and S is a river length;

wherein the high water head, i.e., a land surface water depth $h_g$, which the waterproof doors resist is calculated as:

$$Q_{down} = Q_{up} * (1-\alpha)^{\frac{S}{1000}}$$

$$Q_{down} = AC\sqrt{RJ}$$

$$R = \frac{(x_2 - x_1) * h_r - \int_{x_1}^{x_2} f(x)dx}{\int_{x_1}^{x_2} \sqrt{1 + (f'(x))^2}\, dx}$$

$$A = (x_2 - x_1) * h_r - \int_{x_1}^{x_2} f(x)dx$$

$$h_g = \frac{h_r}{2} * (1-\beta)^{\frac{r}{1000}}$$

wherein $Q_{up}$ is a flow rate of an upstream section, $Q_{down}$ is a flow rate of a downstream section, S is a river length, α is flood peak attenuation coefficient, A is a section area, C is Chezy coefficient, R is a hydraulic radius, Jr is a hydraulic gradient, n is watercourse roughness coefficient, $h_r$ is a river water depth, $h_g$ is a land surface water depth, β is land surface flood water depth attenuation coefficient, $x_1$ and $x_2$ are starting point distances corresponding to two banks when the water depth is $h_r$, f(x) is a polynomial function fitted by an irregular section, and the section f'(x) is the derivative of the fitting equation f(x);

wherein $h_g$ is solved as:

$$\left[\frac{(x_2-x_1)*2*h_g}{(1-\beta)^{\frac{r}{1000}}}-\int_{x_1}^{x_2} f(x)dx\right]*C\sqrt{\frac{\frac{(x_2-x_1)*2*h_g}{(1-\beta)^{\frac{r}{1000}}}\int_{x_1}^{x_2} f(x)dx}{\int_{x_1}^{x_2}\sqrt{1+(f'(x))^2}\,dx}J}=Q_{up}*(1-\alpha)^{\frac{S}{1000}}$$

which is simplified into:

$$c_1^2c_3h_g^3-(c_1^2c_4+2c_1c_2c_3)h_g^2+(2c_1c_2c_4+c_2^2c_3)h_g-(c_2^2c_4+c_5)=0$$

wherein $c_1$, $c_2$, $c_3$, $c_4$, $c_5$ are constants:

$$\begin{cases} c_1=\dfrac{(x_2-x_1)*2}{(1-\beta)^{\frac{r}{1000}}}C \\ c_2=\displaystyle\int_{x_1}^{x_2} f(x)dx*C \\ c_3=\dfrac{(x_2-x_1)*2*J}{\displaystyle\int_{x_1}^{x_2}\sqrt{1+(f'(x))^2}\,dx*(1-\beta)^{\frac{r}{1000}}} \\ c_4=\dfrac{\displaystyle\int_{x_1}^{x_2} f(x)dx*J}{\displaystyle\int_{x_1}^{x_2}\sqrt{1+(f'(x))^2}\,dx} \\ c_5=Q_{up}*(1-\alpha)^{\frac{S}{1000}} \end{cases}.$$

2. The underground temporary danger avoiding system for defending against a short-duration and strong impact of a ground fluid according to claim 1, wherein the life support system comprises a harmful gas removal device, an oxygen supply device, a lighting device, and a device for storing food, clothing and drinking water.

3. The underground temporary danger avoiding system for defending against a short-duration and strong impact of a ground fluid according to claim 1, wherein the rescue device includes a satellite communication device, an emergency power supply, a lifebuoy, life jacket, and a lifeboat.

* * * * *